US007926790B2

(12) United States Patent
James

(10) Patent No.: US 7,926,790 B2
(45) Date of Patent: Apr. 19, 2011

(54) IMPACT SLIDER FOR GUARDRAIL

(75) Inventor: Dallas James, Auckland (NZ)

(73) Assignee: AXIP Limited, Auckland (NZ)

( * ) Notice: Subject to any disclaimer, the term of this patent is extended or adjusted under 35 U.S.C. 154(b) by 0 days.

(21) Appl. No.: 12/132,942

(22) Filed: Jun. 4, 2008

(65) Prior Publication Data

US 2009/0065754 A1 Mar. 12, 2009

Related U.S. Application Data

(62) Division of application No. 10/572,722, filed as application No. PCT/NZ2004/000227 on Sep. 22, 2004, now Pat. No. 7,699,293.

(30) Foreign Application Priority Data

Sep. 22, 2003 (NZ) ..... 528396
Aug. 20, 2004 (NZ) ..... 534826

(51) Int. Cl.
*E01F 15/00* (2006.01)

(52) U.S. Cl. ..... 256/13.1

(58) Field of Classification Search ..... 256/13.1; 404/9, 10

See application file for complete search history.

(56) References Cited

U.S. PATENT DOCUMENTS 3,350,039 A 10/1967 Crater
3,617,076 A * 11/1971 Attwood et al. ..... 403/395
3,738,599 A 6/1973 Borehag
3,776,520 A 12/1973 Charles et al.
3,912,404 A 10/1975 Katt
3,982,734 A * 9/1976 Walker ..... 256/13.1
4,047,702 A 9/1977 Cernia et al.
4,222,552 A * 9/1980 Matteo, Sr. ..... 256/13.1
4,330,106 A * 5/1982 Chisholm ..... 256/13.1
4,655,434 A * 4/1987 Bronstad ..... 256/13.1
4,674,911 A * 6/1987 Gertz ..... 404/6
4,678,166 A 7/1987 Bronstad et al.
4,730,810 A 3/1988 Rambaud
4,739,971 A * 4/1988 Ruane ..... 256/13.1
5,022,782 A 6/1991 Gertz et al.
5,207,302 A 5/1993 Popp et al.
5,391,016 A * 2/1995 Ivey et al. ..... 404/6
5,435,524 A 7/1995 Ingram
5,851,005 A * 12/1998 Muller et al. ..... 256/13.1
5,967,497 A 10/1999 Denman et al.
6,065,738 A 5/2000 Pearce et al.
6,065,894 A 5/2000 Wasson et al.
6,149,134 A * 11/2000 Bank et al. ..... 256/13.1
6,173,943 B1 1/2001 Welch et al.
6,290,427 B1 * 9/2001 Ochoa ..... 404/6
6,398,192 B1 6/2002 Albritton
6,409,417 B1 6/2002 Muller et al.
6,488,268 B1 12/2002 Albritton (Continued)

FOREIGN PATENT DOCUMENTS

WO WO 96/29473 A1 9/1996

(Continued)

*Primary Examiner* — Joshua T Kennedy
(74) *Attorney, Agent, or Firm* — Greer, Burns & Crain, Ltd.

(57) ABSTRACT

An impact slider assembly for a guardrail including a slider connected to a first rail and a slider substantially surrounding the first rail, so that in use, the slider gathers and retains the first and any subsequent rails which telescopically overlap with each other during an impact.

9 Claims, 10 Drawing Sheets

U.S. PATENT DOCUMENTS

| | | | | |
|---|---|---|---|---|
| 6,558,067 | B2 * | 5/2003 | Ochoa | 404/6 |
| 6,926,462 | B1 * | 8/2005 | Fuganti et al. | 404/6 |
| 7,086,805 | B2 * | 8/2006 | Smith et al. | 404/6 |
| 7,396,184 | B2 * | 7/2008 | La Turner et al. | 404/6 |
| 7,445,402 | B1 * | 11/2008 | Chen | 404/6 |
| 2002/0179894 | A1 | 12/2002 | Albritton | |
| 2004/0140460 | A1 | 7/2004 | Heimbecker et al. | |
| 2005/0077507 | A1 | 4/2005 | Heimbecker et al. | |
| 2005/0077508 | A1 | 4/2005 | Bronstad | |
| 2006/0017048 | A1 | 1/2006 | Alberson et al. | |
| 2006/0054876 | A1 * | 3/2006 | LaTurner et al. | 256/13.1 |
| 2006/0102883 | A1 * | 5/2006 | Troutman et al. | 256/13.1 |
| 2007/0252124 | A1 * | 11/2007 | Heimbecker | 256/13.1 |

FOREIGN PATENT DOCUMENTS

| | | | |
|---|---|---|---|
| WO | WO 98/44203 | A1 | 10/1998 |
| WO | WO 99/32728 | A1 | 7/1999 |

* cited by examiner

IMPACT SLIDER FOR GUARDRAIL

CROSS REFERENCE TO RELATED APPLICATION

This application claims the benefit of 35 U.S.C. §120 as a Divisional Application of U.S. Ser. No. 10/572,722, filed Nov. 6, 2006, which is a national stage application of PCT application number PCT/NZ04/00227 filed Sep. 22, 2004, and which has issued as U.S. Pat. No. 7,699,293.

TECHNICAL FIELD

This invention relates to guardrails and in particular, though not solely, to guardrails and/or guardrail impact heads for use in roading networks and/or vehicle road lanes requiring separation by a barrier.

BACKGROUND ART

Existing highway guardrail end treatment systems include: the breakaway cable terminal (BCT), the eccentric loader terminal (ELT), the modified eccentric loader terminal (MELT), the vehicle attenuating terminal (VAT), the extruder terminal (ET 2000 and ET plus), the slotted rail terminal (SRT), the sequential kinking terminal (SKT) and the flared energy absorbing terminal (FLEAT).

Terminal ends (that is, the end facing oncoming traffic) generally consist of one or more, often three, W shaped (in cross-section) guardrails supported by a series of both controlled release terminal (CRT) or frangible posts and standard highway guardrail posts. Generally a cable assembly arrangement is utilised that anchors the end of the rail to the ground, transferring tensile load developed in a side-on impact by an errant vehicle to the ground anchor. Generally the terminal ends have an impact head arrangement that will be the first part impacted by an errant vehicle during an end-on impact which is designed to spread or absorb some of the impact energy.

Some terminal ends such as the abovementioned ET, SKT and FLEAT, absorb the energy of the impacting vehicle during an end on impact by having an impact head that slides down the W shaped guardrails, extruding it and breaking away the support posts as it travels down the rails. All of the other abovementioned terminal ends work on the principal of various weakening devices in the posts and rails to allow an errant vehicle to penetrate the terminal end in a controlled manner and prevent the rails from spearing the vehicle or the vehicle from vaulting or jumping over a relatively stiff terminal end.

All of the abovementioned guardrail terminal ends are considered to be gating, that is, if impacted between the impact head and the "length of need" (where the "length of need" is considered to be the distance from the terminal end to where the guardrail will redirect a vehicle during an angled impact) during an angled impact, the terminal end will gate and allow the errant vehicle to pass to the back side of the terminal end. However this gating effect may have undesirable or unsafe results, and preferably an improved or safer or varied energy absorbing system is utilised to control errant vehicle barrier/guardrail impacts.

It is therefore an object of the present invention to provide a guardrail and/or guardrail impact head which will go at least some way towards addressing the foregoing problems or which will at least provide the industry with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

DISCLOSURE OF INVENTION

Accordingly, in a first aspect, the invention may broadly be said to consist in an impact head for a guardrail comprising:

a cable routing means which forms a tortuous path through which a cable is adapted to be threaded in order to provide resistance to cable movement therethrough.

The inventor considers that a barrier may be defined as: "A barrier formed from rails or cables, placed along an edge of a road or highway, particularly at dangerous points in the road."

Preferably, during a collision or impact with the impact head the cable is forced through the cable gripping means, where resistance to cable movement substantially facilitates impact energy dissipation.

In a second aspect, the invention may broadly be said to consist in a guardrail comprising:

a plurality of spaced apart support posts at least some of which have a predetermined failure load, a plurality of rails slidably interconnected and mounted directly or indirectly to said posts, at least one cable provided along at least a part of the length of said slidably interconnected rails wherein each end of said at least one cable is fixed in relation to the ground and an impact slider assembly substantially surrounding a first rail and including a portion which gathers and retains telescoping rails during an impact.

With regard to the present invention a rail and/or impact slider assembly that is directly attached to posts may be attached by screws, bolts or frangible fasteners onto the said post. A rail and/or impact slider assembly referred to as being indirectly attached to said posts may be attached to a spacer or other intermediary structure between the post and rail and/or impact slider assembly.

Preferably, said at least one cable is substantially located within aligned recesses of the plurality of slidably interconnected rails.

Preferably, the at least one cable is tensioned.

Preferably, the at least one cable, at least at one end thereof, is anchored to a ground anchor.

Preferably, the remaining end of the at least one cable is anchored to a rail and/or a support post.

Preferably, where the at least one cable is anchored to a support post without a predetermined failure load, the support post has a greater failure load than that of the predetermined failure load support posts.

Preferably, the slidably connected rails telescope upon an impact substantially in-line with the longitudinal direction of the slidable rails.

Preferably, the rails are separated from the support posts by a spacer.

Preferably, frangible fasteners connect a plurality of rails to one another and/or to said posts.

Preferably, the impact slider assembly is attached to the end of a first rail at or near a connection with a second rail, wherein the impact slider assembly or part thereof is slidable along the second rail.

Preferably, the movement of the impact slider assembly along the second rail disconnects the second rail from its associated post or posts.

In a third aspect, the invention may broadly be said to consist in a guardrail comprising:

a plurality of spaced apart support posts, at least some of which have a predetermined failure load, a plurality of rails slidably interconnected and mounted directly or indirectly to said posts, at least one cable provided along at least a part of the length of said slidably interconnected rails wherein each end of said at least one cable is fixed in relation to the ground, and an impact head in accordance with the first aspect positional at one end of the slidably interconnected rails and through which at least one of said at least one cable is routed in said tortuous path.

Preferably, the end of at least one cable located farthest from the cable gripping means is anchored to a rail and/or a support post.

Preferably, the impact head is mounted to a first support post.

Preferably, the impact head is mounted to a rail.

Preferably, the cable routing means is mounted to a first support post.

Preferably, the cable routing means is mounted to a rail.

Preferably, the cable routing means is connected to an end of a plurality of interconnected rails.

Preferably, the impact slider assembly is a housing which substantially surrounds a rail.

Preferably, the impact slider assembly substantially conforms with the rail profile.

Preferably the impact slider assembly, in use, impacts the rail and post connections and disconnects the rail and post.

Preferably, the means for gathering and retaining the rails during an end on impact is by an impact slider assembly and includes telescoping of the rails.

Preferably the adjacent ends of the rails overlap so as to allow rails to slide over each other.

Preferably the overlap between rails is proximate the impact slider assembly.

Preferably, the means for gathering and retaining is a pair of L-shaped arms extending rear-wardly from the impact slider assembly, in the direction of the support post.

Preferably, the cable routing means is mounted on a first post, the impact slider assembly or part thereof is attached to the end of a first rail.

In a third aspect the present invention provides an impact slider assembly for a guardrail including an impact slider panel connected to a first rail substantially surrounding the first rail so that in use, the impact slider panel gathers and retains the first and any subsequent rails which telescopically pass across each other during an end on impact with the guardrail.

Preferably, the rails telescope upon an impact substantially in-line with the longitudinal direction of the rails.

Preferably, the impact slider assembly or part thereof is attached to an end of the first rail at or near a connection of the first rail to the second rail.

Preferably, the impact slider assembly is adapted so that, in use, it may impact the rail to rail and rail to support post connections and thereby disconnect the rails and support post.

Preferably, the impact slider assembly includes:

an impact slider panel, an impact slider bracket,

Wherein the impact slider bracket includes an angled bar which, in use, is not able to pass through the passage in the impact slider panel.

Preferably the impact slider panel is attached to the first rail.

Preferably the attachment of the impact slider panel to the first rail is with non frangible bolts or screws.

Preferably the impact slider bracket is attached to the second rail.

Preferably the attachment of the impact slider bracket to the second rail is with non frangible bolts or screws.

In preferred embodiments the Impact slider panel is attached to the first rail, the traffic side (or front) face of the first rail abutting the traffic side inner face of the impact slider panel. The second rail traffic side (front) face under lapping the first rail. Preferably, in use, the impact slider bracket is attached to the rear face of the second rail, the angled bar being positioned on the same side of the impact slider panel as the first rail projects from.

It will be apparent to those skilled in the art that the manner in which the impact slider assembly might be adapted to facilitate the disconnection of the rail and support post connections, may be by being fabricated from a substantially more resilient material than the said connections. The resilience of the impact slider assembly thereby causing the connections to shear off when impact energy is transferred through the rail to the impact slider assembly causing it to impact said rail and support post connections.

The deflection of a vehicle impacting against a guardrail that results in the vehicle being re-directed back onto the road is for the purposes of this specification defined as being re-directed. A fully re-directing guardrail is therefore one which redirects any vehicle impacting with the guardrail at some angle of incidence back onto the road.

Preferably, the connection between the impact slider assembly or part thereof and the support post is frangible.

Preferably, one or more of the support posts has a predetermined failure load.

In a further aspect the present invention also provides a guardrail including:

a plurality of support posts, a plurality of rails slidably interconnected and mounted directly or indirectly to said posts, and an impact slider assembly substantially surrounding a first rail and including a portion which gathers and retains telescoping rails during an impact.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

This invention is designed to be a substantially non-gating guardrail, meaning that at any point along the side of the guardrail from the terminal end onwards, an impacting vehicle on an angled collision may be substantially redirected away from its initial impact trajectory. It is also designed to substantially absorb energy during an end on impact to the terminal end.

"Gating" is a term used within the guardrail industry to refer to sections of guardrail which are unable to withstand high impact side angle collisions, and significant guardrail deformation or ultimate failure or breakage may occur.

Figure 1A:
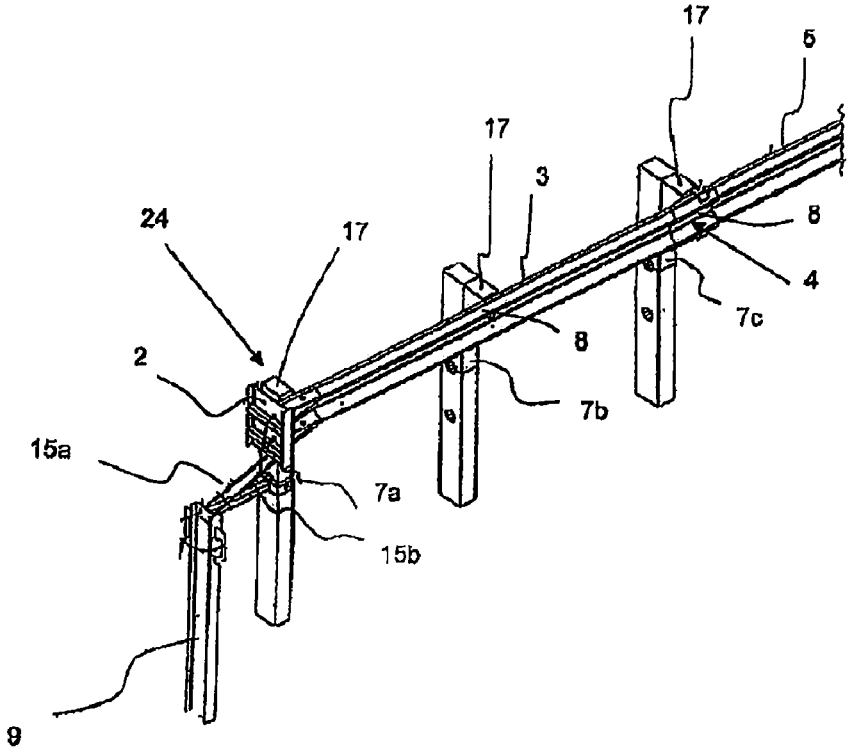
FIGS. 1*a* and 1*b*: are perspective views from the impact side of one embodiment of a guardrail according to the present invention.
Figure 1B:
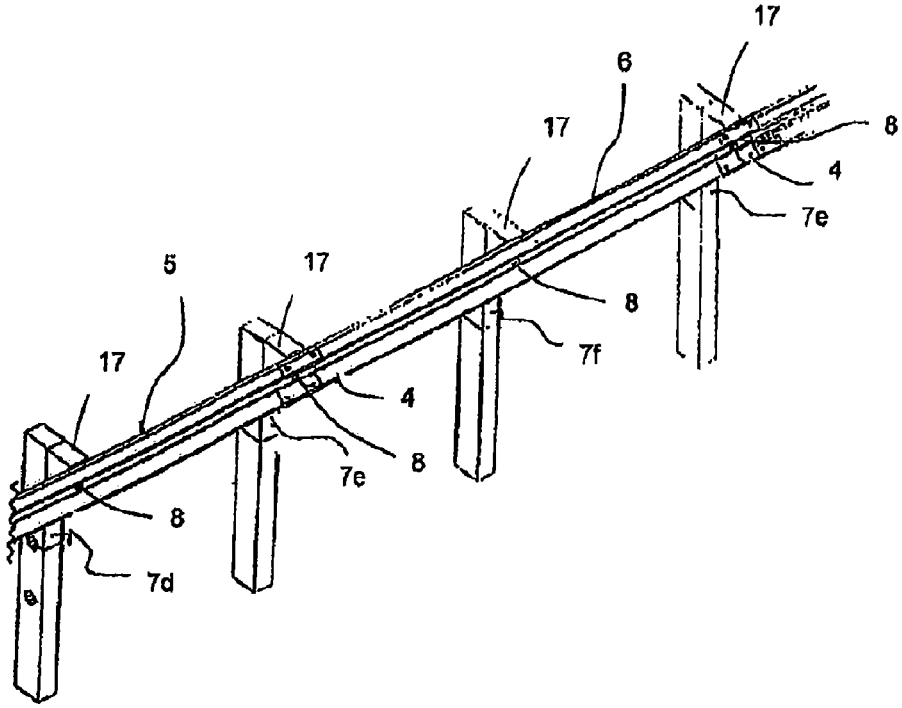
Figure 2A:
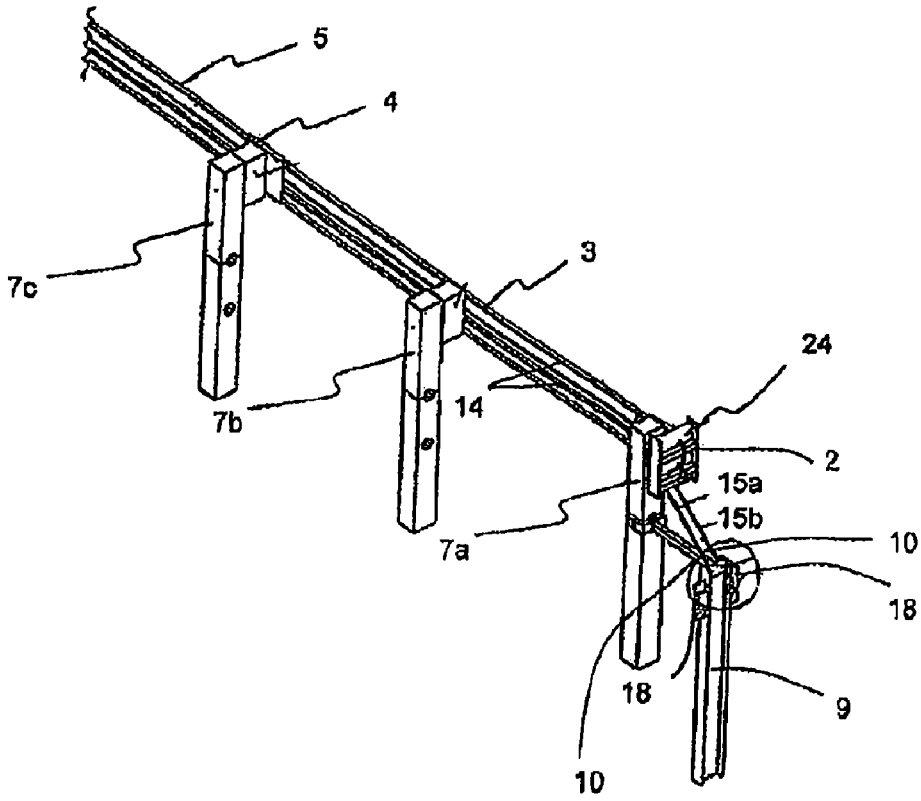
FIGS. 2*a* and 2*b*: are reverse perspective views of the guardrail of FIGS. 1*a* and 1*b*.
Figure 2B:
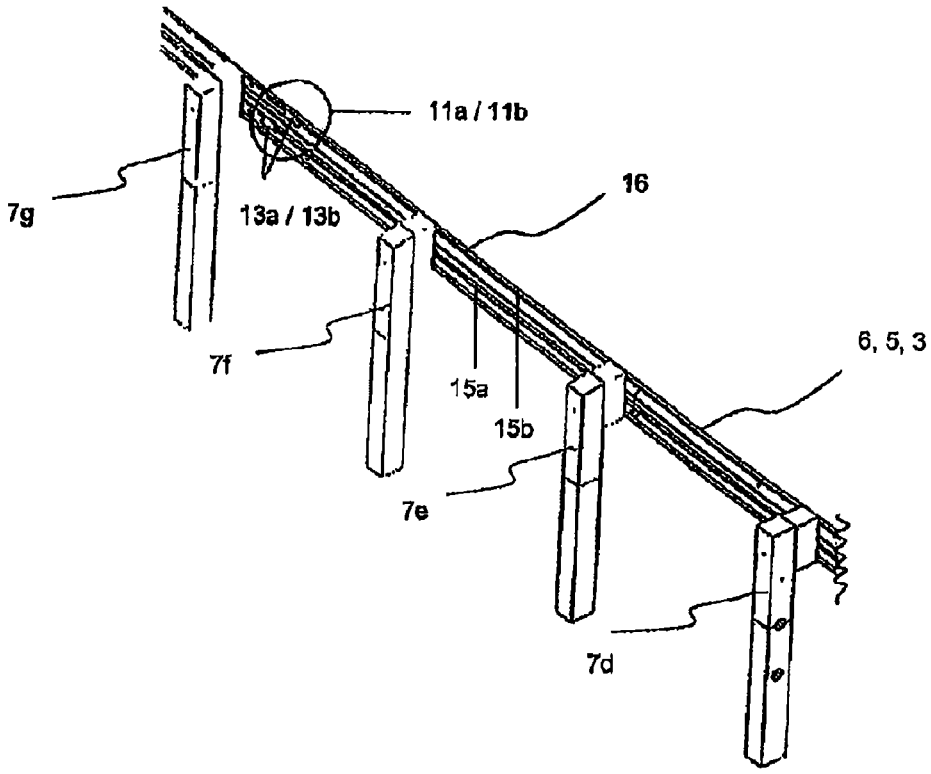

For the purposes of this illustrative description, FIGS. 1*a* and 1*b* will be referred together as FIG. 1; similarly FIGS. 2*a* and 2*b* will be referred to as FIG. 2. The guardrail (1) shown has been split into two sections for illustrative purposes only, and sections A and A' in FIGS. 1*a* and 1*b*; and the same sections are labelled B and B'in FIGS. 2*a* and 2*b* should be joined to show an embodiment the guardrail according to the present invention.

In a first embodiment of the present invention, and with reference to FIGS. 1 and 2 there is provided a guardrail (1) with a cable routing or gripping means (2) at the terminal end. The cable gripping means (2) may form part of an impact head (24) (where an impact head is an additional guardrail bumper used to initially absorb some impact energy).

The cable gripping means (2) (and optionally impact head 24) may be bolted to the first rail (3), at the other end of which is connected an impact slider assembly (4). The impact slider assembly 4 may facilitate the sliding of the first rail (3) over each subsequent rail (5,6), thereby providing a substantial telescoping ability to the guardrail, (1) with each rail overlapping the next rail to enable this process during an end-on impact. First rail (3) telescoping over second subsequent rail (5) and second subsequent rail (5) telescoping over further subsequent rail (6) during an end-on impact. It would be obvious to a person skilled in the art that any number of preceding rails could telescope over a further subsequent rail (not shown), therefore the number of telescoping rails should not be seen as being limiting. The impact slider assembly (4) may substantially surround the first rail (3) and advantageously includes an impact slider panel (33), most clearly shown in FIG. 4, which gathers and retains telescoping railings during an impact.

The rails (3, 5, 6) may be supported by upstanding CRT (controlled release terminal) (7*a*, 7*b*, 7*c*, 7*d*) and/or frangible posts and/or posts of a predetermined failure load or any combination of these post types which will now be collectively referred to by designation (7). The rails (3, 5, 6) may be directly attached (not shown) to the posts, (7) or alternatively may be indirectly attached via spacers (17) or similar block type arrangement.

The impact slider assembly (4) may also be used to detach or facilitate the disjointing or disconnection of a connection such as bolt 8 between a rail (3, 5, 6) and a CRT (7). Preferably the impact slider assembly (4) is a structural member of suitable strength that allows the bolts (8) (or similar connector) connecting rail (5) to posts (7*c,d,e*); or rail (5) to rail (3) or the next rail (6); to either be severed from the rail or pulled or bent free from the rail connection. The rails (3, 5, 6) may be connected to each other separately from support post connections (8). Depending on the strength and/or impact force generate by an impact with guardrail impact head (24) and subsequently the impact slider assembly (4), the bolts (8) may be made of materials such as plastics or high density plastic or other composite materials, or frangible bolts, which are more likely to fail and shear off from the post connection (or from the rail to rail connection) by an impact from the impact slider assembly (4), than a side angle impact with the guardrails (3, 5, 6). This may be an advantageous feature allowing the impact slider assembly (4) to operate and shear off post holding rail bolts (8), whilst at the same time providing resistance to side angle impacts and reducing the likelihood of the guardrail gating.

Ideally bolt (8), is frangible and, is preferably a bolt, screw or similar threaded securing means. Such a securing means can be used to connect the guardrail rails (3, 5, 6) to the support posts (7), and may be especially suitable for use with the impact slider assembly (4). For instance, the impact slider assembly (4) can impact the frangible bolt (8) holding the rails (3, 5, 6) onto the support posts (7), the bolt (8) will be subjected to a shear force or impacting force, and can break (or structurally fail). An impact with the bolt in a direction in-line with the longitudinal axis, of the bolt (8) is less likely to induce bolt (8) failure, as the impacting force is substantially compressive down the longitudinal axis of the bolt (8) and is therefore unlikely to result in the bolt (8) breaking.

As shown in FIG. 2, a cable (or cables) 15*a*, 15*b* has an end 10 which may be attached to a soil anchor assembly (9) or otherwise fixed adjacent (not shown) the impact head (24). The other cable end (11*a*, 11*b*) extends to a second anchor or fixed point, which may be a further soil anchor assembly (not shown), or alternatively, may be an anchoring assembly attached to a non-frangible support post (not shown) or non-telescoping rail (16). The cable (15*a*, 15*b*) may be anchored by cable brackets (13*a*, 13*b*) to the posts (7*a-g*) or a non-telescoping rail (16) or by any suitable cable anchoring system, such as bolts and welds or the like. The soil anchor assembly (9) may include a sunken post (or I-beam) with flares or winged portions (18) extending outwards from the post to engage with greater soil area and providing increased resistance to movement of the anchor assembly (9) as a result of an impact with the guardrail (1).

The embodiment shown in FIGS. 1 and 2 of a guardrail (1) consists of a soil anchoring system (9) at the impact head (24) end of the guardrail (1) and provides a means to attach two cables (15*a*, 15*b*) thereto. The cables (15*a*, 15*b*) are preferably threaded in a substantially S-shape (or Z-shape), through the cable gripping means (2), which may be a steel plate bolted to the impact head (24) (or first post 7*a*). At the junction of the first (3) and second (5) rails (or sections of rails), there is an impact slider assembly (4) that fits over the end of the first rail (3) and into which the next rail (5) may slide.

The term up-road will for the purposes of this specification be used to describe a position on one side of a road that is located some distance further along that one side of the road in regard to a vehicle correctly travelling on that side of the road. It would be apparent that given this definition, that to vehicles travelling correctly on opposite sides of the same road, up-road will be in opposing directions.

The cables (15*a*, 15*b*), after being threaded through the cable gripping means (2), are positioned in a hollow or recess (14) in the back side of the length of the rail (3, 5, 6) (for example, the rail may be a W-shaped extrusion, the lower portion of the W preferably forming the front or road side of the rail, the cable (15*a*) being located in one channel formed by the W and cable (15 *b*) being located in the other). The cables (15*a*, 15*b*) may extend until a point (11*a*, 11*b*) where they may be anchored to the rail (13*a*, 13*b*) (or post, or other anchoring means) at a post up road of the cable gripping means (2) using one or more cable brackets (13*a*, 13*b*) or other connecting and/or cable fixing means. Such means may be screws, bolts, welded joints or other suitable devices enabling substantially secure cable anchoring. The cable (15*a*, 15*b*) may be tensioned, although this is not essential for the present invention to operate.

In use, energy from a head on impact with the impact head (24) is initially substantially absorbed by support post (7*a*), which may subsequently fail, preferably substantially at or near ground level. For example the first support post (7*a*) would normally be impacted at or by the impact head (24), and absorb energy before preferably failing (that is, being broken). Should a support post (7*a*-*g*) fail and be broken off at a height substantially above ground level (not shown) the impacting vehicle may collide with the broken post which may result in more severe impact energy absorption (possibly resulting in vehicle occupant damage due to sudden movement arrest).

Similarly, as the slider device (4), impact head (24) and first rail (3) (and subsequent rails) (5, 6) telescope together, each support post (7*a*-*g*) is impacted by the or a slider device (4) and preferably causes breakaway of the posts (7*a*-*g*). Alternatively, a guardrail (1) may also be provided in which just an impact slider (4) is connected to the rails (3, 5, 6), and no cable gripping means or impact head is attached.

Preferably, the guardrail (1) employs energy absorption/dissipation systems which substantially control an impacting objects momentum and directional motion. For example, energy may be absorbed or dissipated by the friction between the cable (15*a*, 15*b*) and cable gripping means (2). When the guardrail (1) is impacted end on (that is, in the substantially longitudinal direction of the guardrail and impacting the impact head (24) initially), the whole of rail (3), the impact head (24), cable gripping means (2) and the impact slider assembly or part thereof (4) move in a telescoping manner over rail (5) and then subsequent uproad rails, such as rail (6). Energy is also absorbed by the friction of the cables (15*a*, 15*b*), which are fixed to a soil anchor (9) or similar, running through the cable gripping means (2), wherein the threaded cable configuration through the cable gripping means (2) follows a tortuous pathway.

Preferably, as the cable gripping means (2) is attached to or forms an integral part of an impact head (24), as the impact head (24) and cable gripping means (2) move (as a result of an end-on impact with the impact head (1)), up road from the cable anchor point 11, the cable gripping means (2) is effectively forced to move along the cable(s) (15*a*, 15*b*), whilst the cable(s) (15, 15*a*) remain substantially stationary as a result of being fixed at each of their ends. In doing so, the cable is forced through a number of bending movements created by the threading configuration in the cable gripping means (2). Preferably, the cable (15*a*, 15*b*) used has substantial resistance to flexing (such as steel cable), and energy is dissipated from the impact and imparted to energy used to bend the cable.

Additionally, as the cable gripping means (2) moves along the cable(s) (15 and 15*a*), the cable is forced to run in surface-to-surface contact with the cable gripping means (2), which preferably results in additional frictional energy dissipation. In an even further alternative embodiment, the cable gripping means (2) may be in the form of a sleeve (not shown) fitted around the cable (15, 15*a*) which is snug around the cable and provides frictional resistance to relative movement of either the sleeve or cable. In an even further preferred energy dissipation system, the friction created by the impact slider assembly (4) (and rails 3, 5, 6) telescoping over one another during an impact event may help to absorb energy.

Energy from a side angle impact with the guardrail 1 is absorbed by the flexion and/or deformation (whether by elastic or plastic deformation) of the rails (3, 5, 6), as well as by the tensile forces created in the cable(s) 15, 15*a* (which may help the rails to resist flexion and/or deformation).

Preferably, the impacting object is redirected away from the guardrail 1 and the forces generated by the impact are distributed throughout the rails (3, 5, 6) and cables (15*a*, 15*b*) either by deformation or tension generated in the cables (15*a*, 15*b*) and subsequently redirected to the cable fixing point (11, 11*a*).

Preferably, a number of support posts (7*a*-7*g*) may be frangible or of a pre-determined failure load which fail or substantially deform, consequently absorbing further impact energy.

Preferably an object, such as a vehicle, involved in a side angle impact is substantially redirected away from the guardrail (1), and back onto the road, and the rail (3, 5, 6) is restrained from "gating" by the further tension created in the cables (15*a*, 15*b*) by the impacts induced lateral cable (15*a*, 15*b*) movement.

Figure 6:
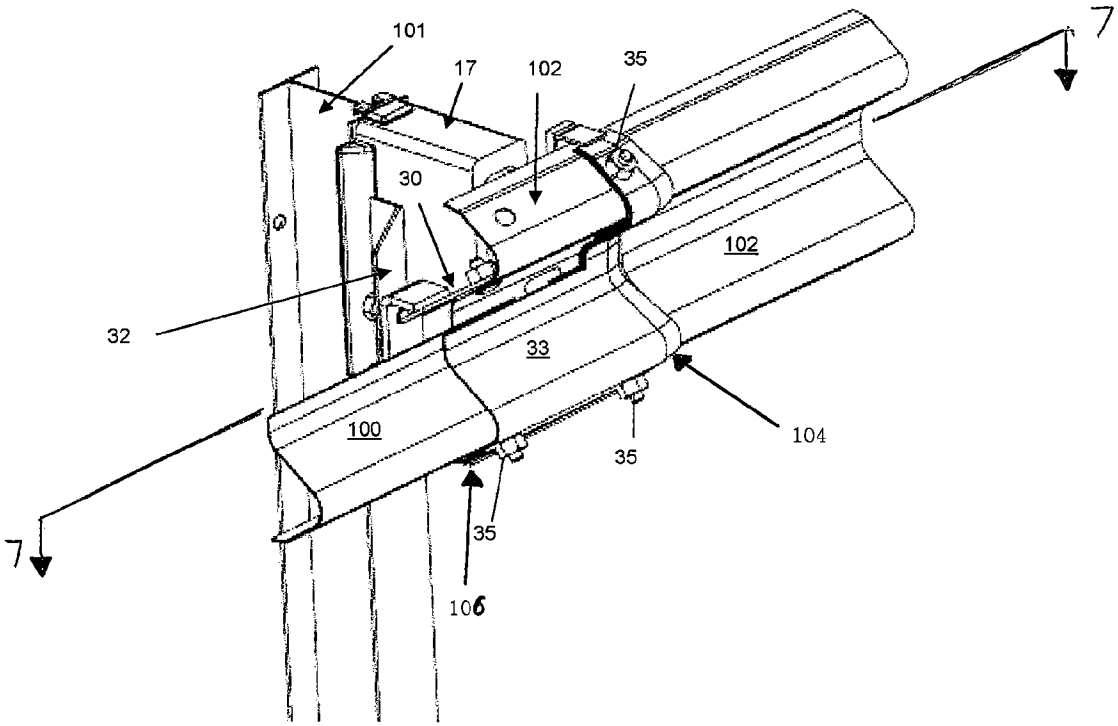
FIG. 6: is an inverted front perspective view of a preferred impact slider assembly comprising the slide bracket and slide panel of FIGS. 3 and 4 according to the invention as mounted to the support post, with portions removed for clarity.
Figure 7:
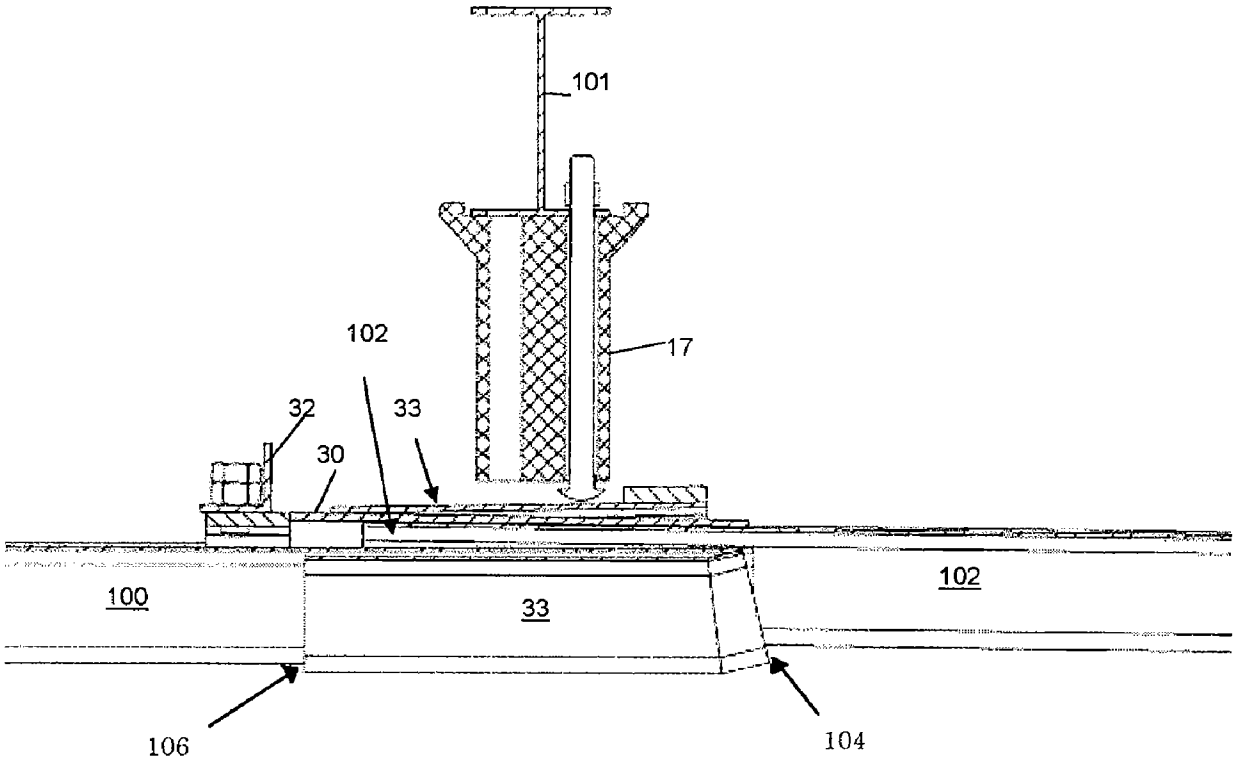
FIG. 7: is a horizontal cross-sectional view of a preferred impact slider assembly taken across the line 7-7 shown in FIG. 6 and taken in the direction indicated.
Figure 8:
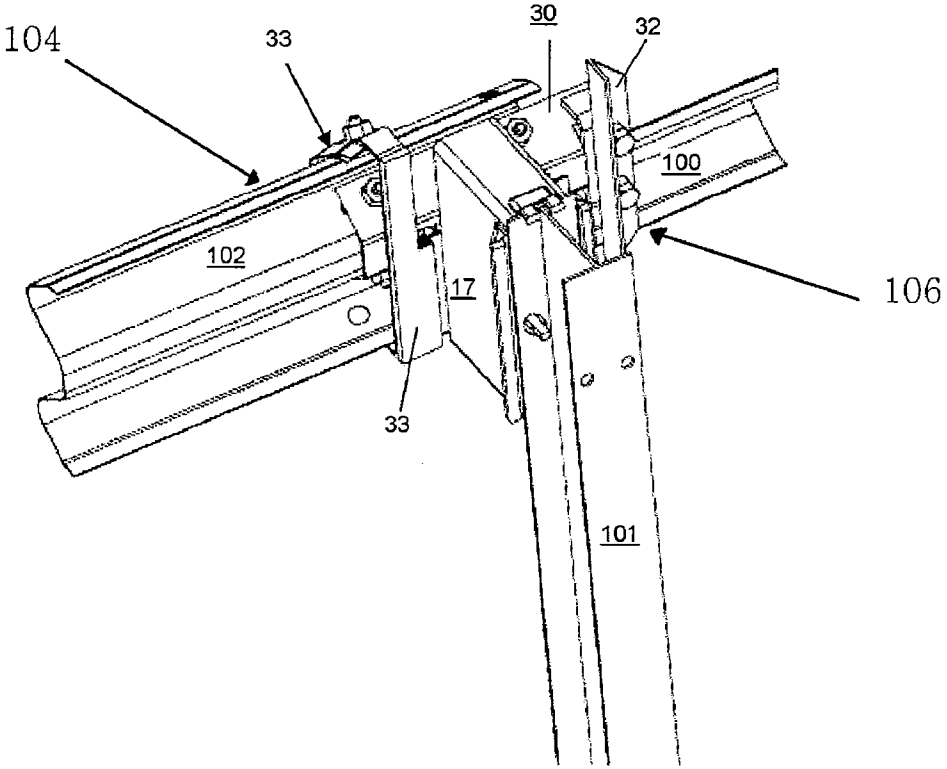
FIG. 8: is an inverted rear perspective view of a preferred impact slider assembly comprising the slide bracket and slide panel of FIGS. 3 and 4 according to the invention as mounted to the support post, for portions removed for clarity.

FIGS. 5-8 shows an impact slider assembly (4) which includes means for attachment to a first rail (100) (not shown in FIGS. 3 and 4 but shown in FIGS. 5-8) in the form of a slider panel (33) which substantially conforms with the rail (100) profile and with integral means for attachment to said first rail (100) in the form of slotted holes (34, shown in FIG. 4) through which, in one preferred embodiment, fasteners (35) may be passed and secured to said first rail (100), thereby substantially surrounding the first rail (100), the second rail (102), and the impact slider bracket (30). As shown in FIGS. 6-8, the first rail (100) passes through the impact slider panel (33) to a first side (104) of the impact slider panel, and the second rail (102) passes through the impact slider panel to an opposite second side (106) of the impact slider panel. The impact slider panel (33) also including further integral means for attachment (37) of the impact slider assembly (4) to a support post or support post spacer (17).

Figure 3:
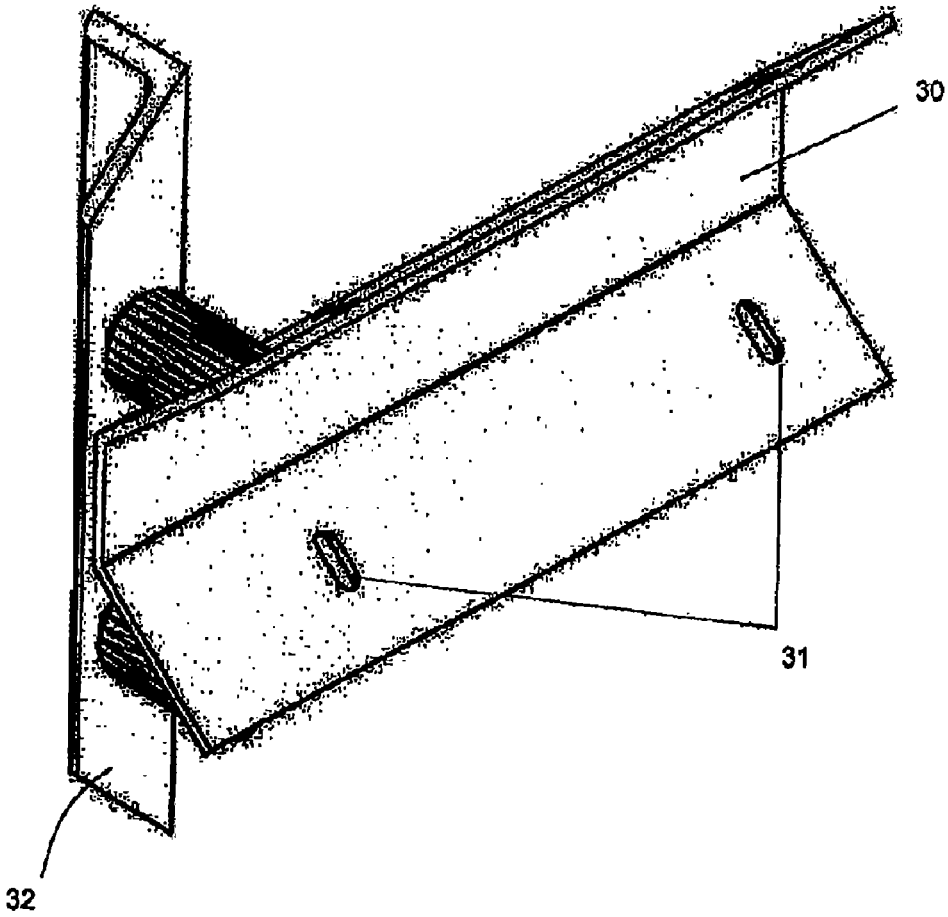
FIG. 3: is a perspective view of an impact slider bracket according to a preferred embodiment of the invention.
Figure 4:
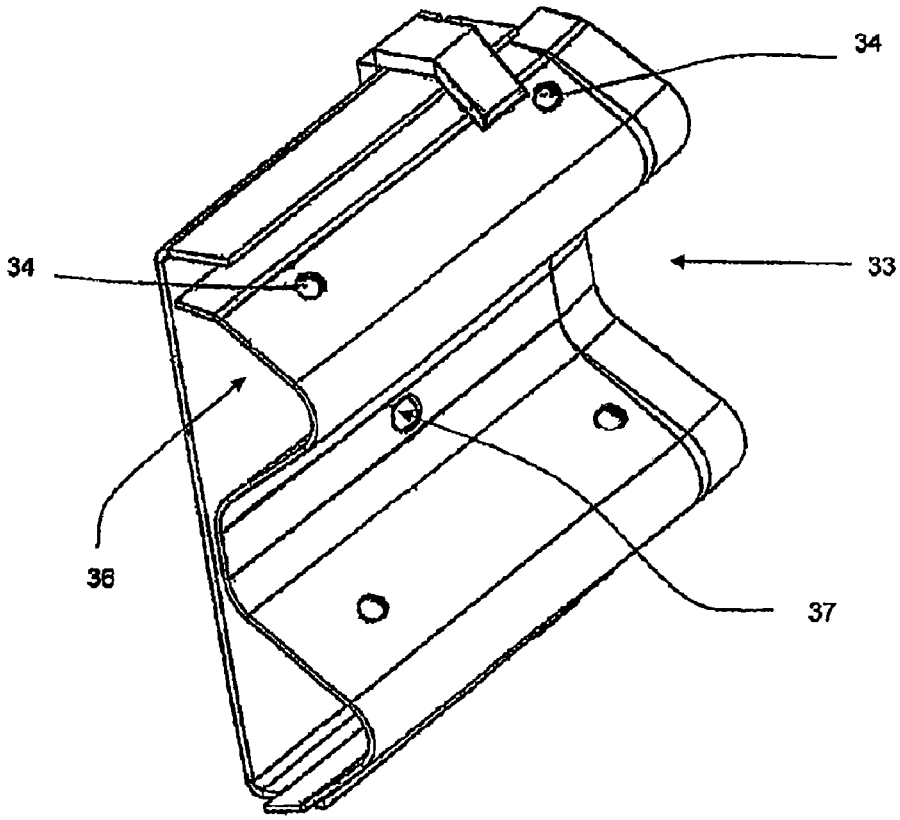
FIG. 4: shows an impact slider panel (not attached to support posts) according to a preferred embodiment of the invention.
Figure 5:
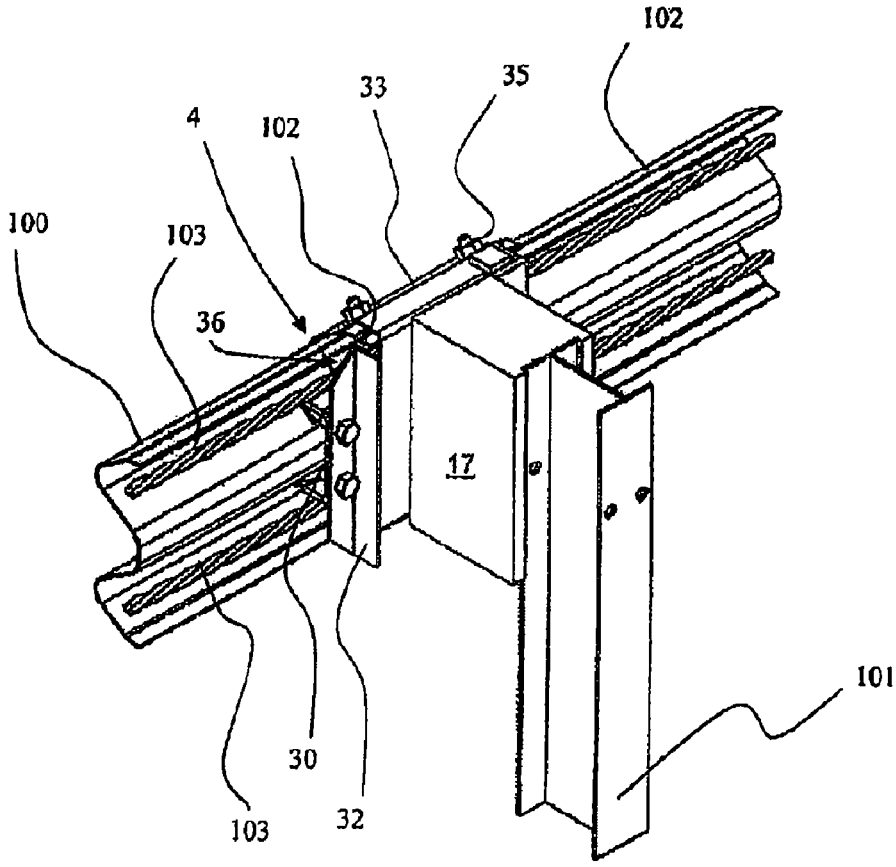
FIG. 5: is a rear perspective view of a preferred impact slider assembly comprising the slide bracket and slide panel of FIGS. 3 and 4 according to the invention as mounted to the support post.

In use the impact slider bracket (30) shown in FIG. 3, which in one preferred embodiment may be fastened to second rail (102), and the attached L shaped bracket (32) may butt up against one end of the impact slider assembly (4) so as to hold the second rail (102) (not shown in FIGS. 3 and 4 but shown in FIGS. 5-8) within the impact slider panel (33), shown in FIG. 4, against any tensile force acting to pull the second rail (102) from the impact slider panel (33). Thereby providing support to the second rail (102) via the support post (101, shown in FIGS. 5-8), and spacer (17) (if present).

The impact slider bracket (30), shown in FIG. 3, also has apertures for attachment (31) via fasteners (not shown) to the second rail 102), although this is a preferred embodiment and, in other embodiments, the impact slider bracket (30) may be attached to the first rail (102), or to both the first (100) and second (102) rail.

In use, and upon an angular impact with the second (102) or subsequent rail (not shown in FIGS. 5-8, but shown as 5 or 6 in FIGS. 1 and 2) of the guardrail (1), whereby a vehicle is impacting from the traffic side of the rail (the top left hand corner as viewed in FIG. 5), the slider bracket (30), preferably attached to the second rail (100), and L shaped bracket (32) prevents the second rail (102) from pulling through the slider panel (33), and thereby gating. The L shaped bracket (32) being unable to fit through the passageway (36) through slider panel (33).

In use and upon an end on impact with the guardrail (1), the impact energy that is not dissipated by the impact head (2, shown in FIGS. 1 and 2) and first post (7*a*, shown in FIGS. 1 and 2) is transferred longitudinally down the first rail (100, FIGS. 5-8) to impact slider panel (30), this may cause the impact slider assembly (4) to come free of the support post (101) by breaking the frangible fastening (8, shown in FIGS. 1 and 2) of the impact slider assembly (4) to the support post (101) (whether via a spacer (17) or not) and (if present) rail to rail connections (not shown) so that the rails (100, 102). As the impact slider panel (33) still surrounds both the first (100) and second (102) rail it may gather telescoping rails (100) approaching from the left hand side in FIGS. 5-8 whilst maintaining or at least substantially maintaining the rails in a "non-gating" configuration, that is, that the first rail (100) (that shown on the left hand side of FIGS. 5-8) may move substantially along the length of the second rail (102) (shown on the right in FIGS. 5-8).

There is a low probability of penetrating through to the protected side (the bottom right corner as shown in FIGS. 5-8) and thereby preventing "gating" of the rails. Passing through the bracket assembly A are cables (103).

The L shaped angle bracket (32) is attached to the impact slider bracket (30) and upon side angle impacts with the second rail (102) or subsequent, prevents the joint between rail (100) and rail (102) from separating. This is achieved by the L shaped angle bracket (32) being larger than the impact slider panel (33) and therefore being unable to pass through the impact slider panel (33).

The guardrail as described goes at least some way toward facilitating a system for controllably slowing a vehicle during an end-on barrier impact, as well as some way towards preventing the guardrail from gating during a side angled impact. It is also preferable that the "length of need" is substantially reduced compared to various existing technologies, and may most preferably have a length of need of almost zero distance.

The guardrail as described may be utilised to form a part of whole of a guardrail system, although this system in particular may be applied to the terminal ends of a required guardrail or barrier or be substantially retrofit-able to existing guardrails.

Aspects of the present invention have been described by way of example only and it should be appreciated that modifications and additions may be made thereto without departing from the scope of the appended claims.

I claim:

1. An impact slider assembly for use with a guardrail system having at least one support post, a first rail, and a second rail, said assembly comprising:

an impact slider bracket configured for attachment to the second rail;

an impact slider panel movable independently of the at least one support post, wherein the impact slider panel is configured for attachment to the first rail and substantially surrounding the first rail, the second rail, and said impact slider bracket, and wherein the first rail passes through an opening in said impact slider panel to a first side of said impact slider panel and said second rail passes through said impact slider panel to an opposite second side of said impact slider panel, such that the first and second rails overlap, wherein the impact slider panel gathers and retains the first and second rails during a substantially longitudinally directed impact that causes telescoping of the first and second rails at said impact slider panel and a stop fastened to the impact slider bracket, wherein the stop abuts against and is larger than the opening at the second side of the impact slider panel thereby preventing said stop from passing through said impact slider panel as a result of longitudinal pulling caused by a side impact and thus preventing the overlap between the first and second rails from separating.

2. An impact slider assembly as claimed in claim 1, wherein said impact slider assembly is configured for receiving at least one rail in addition to the first rail and second rail as adjacent rails telescope upon an impact substantially in-line with the longitudinal direction of the first, second, and the additional at least one rails.

3. An impact slider assembly as claimed in claim 1, wherein the impact slider panel is fastened to the first rail using at least one fastener.

4. An impact slider assembly as claimed in claim 3, wherein no direct connection exists between said impact slider assembly and the at least one support post adjacent to the first rail and the second rail.

5. An impact slider assembly as claimed in claim 1, wherein, in use, upon an impact occurring end on with respect to a guardrail, said impact slider panel is adapted so that, any relative movement between said impact slider panel and any of the rails and/or a support post occurring due to an impact force results in said impact slider panel shearing the corresponding rail or support post connections so as to disconnect the corresponding rails or support posts from one another.

6. A guardrail system for use with a support post, said system comprising:

a first rail and a second rail;

an impact slider assembly having an impact slider bracket affixed to said second rail, and an impact slider panel attached to said first rail and which substantially surrounds said first rail and said second rail and which substantially conforms with a rail profile, said impact slider panel being configured to move independently of the post; and an integral means for attachment of the impact slider panel to said first rail, wherein said first rail passes through an opening in said impact slider panel to a first side of said impact slider panel and said second rail passes through an opening in said impact slider panel to an opposite second side of said impact slider panel, and wherein the impact slider bracket is affixed to said second rail on the second side of said impact slider panel, such that the first and second rails overlap and wherein, the impact slider panel gathers and retains said first and said second rails of the guardrail during a substantially longitudinally directed impact that causes telescoping of the first and second rails at said impact slider panel; and a stop fastened to the impact slider bracket, wherein the stop abuts against and is larger than the opening at the second side of the impact slider panel thereby preventing said stop from passing through said impact slider panel as a result of longitudinal pulling caused by a side impact and thus preventing the overlap between the first and second rails from separating.

7. A guardrail system as claimed in claim 6 wherein said impact slider panel includes at least one fastener which passes through and secures said impact slider panel to the first rail.

8. A guardrail system as claimed in claim 6 wherein the stop comprises an angled bar is fastened to said impact slider bracket which abuts against at least one edge of said impact slider panel.

9. A guardrail system as claimed in claim 8 wherein said angled bar is substantially L-shaped.

* * * * *